US008077111B2

(12) United States Patent
Derneryd et al.

(10) Patent No.: US 8,077,111 B2
(45) Date of Patent: Dec. 13, 2011

(54) OPTIMIZED RADIATION PATTERNS

(75) Inventors: Anders Derneryd, Göteborg (SE); Ulrika Engström, Floda (SE); Lars Manholm, Göteborg (SE); Sven Petersson, Sävedalen (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 373 days.

(21) Appl. No.: 12/515,588

(22) PCT Filed: Nov. 23, 2006

(86) PCT No.: PCT/SE2006/050503

§ 371 (c)(1),
(2), (4) Date: May 20, 2009

(87) PCT Pub. No.: WO2008/063111

PCT Pub. Date: May 29, 2008

(65) Prior Publication Data

US 2010/0066634 A1 Mar. 18, 2010

(51) Int. Cl.
*H01Q 21/00* (2006.01)

(52) U.S. Cl. ..... 343/853; 343/893; 342/375

(58) Field of Classification Search ..... 343/853, 343/893, 797; 342/375
See application file for complete search history.

(56) References Cited

U.S. PATENT DOCUMENTS 6,282,434 B1 * 8/2001 Johannisson et al. ..... 455/562.1
6,304,214 B1 * 10/2001 Aiken et al. ..... 342/362
7,652,623 B2 * 1/2010 Oomuro ..... 342/360

FOREIGN PATENT DOCUMENTS

JP 2006-060682 A 3/2006
JP 2006-186841 A 7/2006

* cited by examiner

*Primary Examiner* — Douglas W Owens
*Assistant Examiner* — Dieu H Duong

(57) ABSTRACT

An antenna arrangement comprising at least two antenna arrays, each array comprising a plurality of radiating elements being arranged so as to have at least a plurality of corresponding radiating element positions, wherein for each radiating element there is associated an excitation means comprising a magnitude weight and a delay weight, wherein there is a first set of excitation means associated with a first array providing a first radiation pattern and a second set of excitation means associated with a second array providing a second radiation pattern. At least two respective excitation means associated with a corresponding radiating element position of at least two respective arrays have at least two different magnitude weights, and at least two respective excitation means associated with a corresponding radiating element position of at least two respective arrays have at least two different delay weights.

17 Claims, 8 Drawing Sheets

Figure 8A:
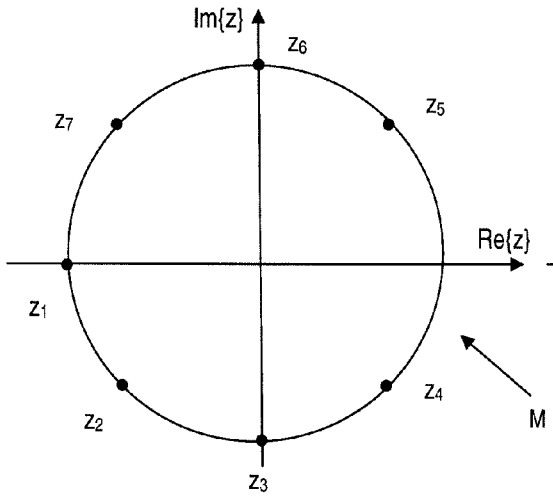

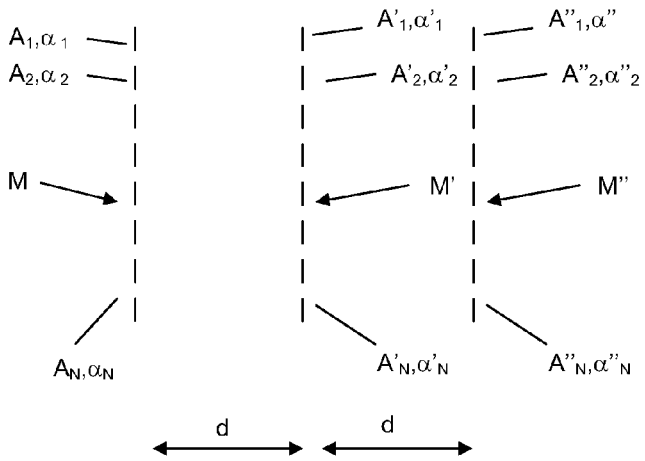
PRIOR ART FIG. 1
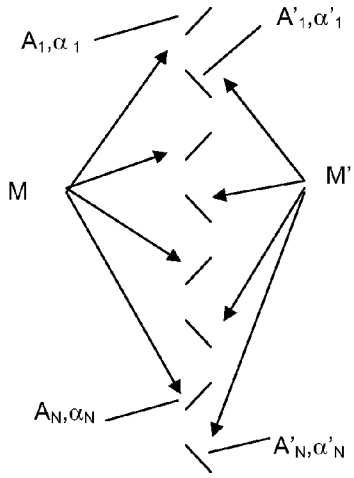
PRIOR ART FIG. 2
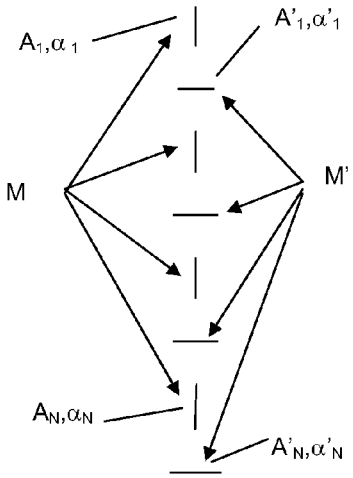
PRIOR ART FIG. 3
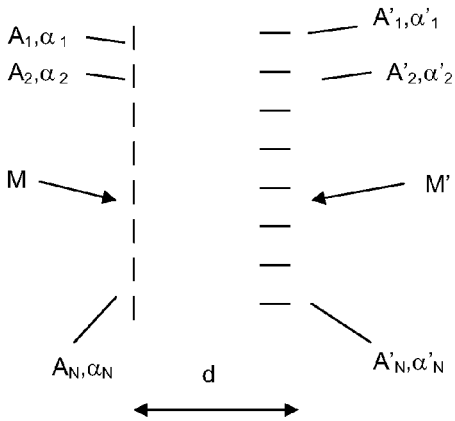
PRIOR ART FIG. 4

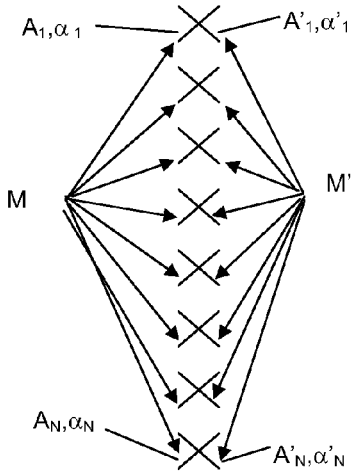
PRIOR ART FIG. 5
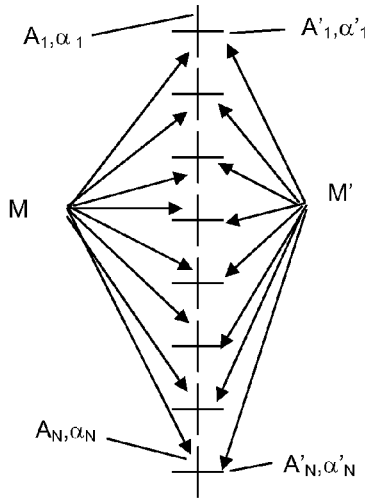
PRIOR ART FIG. 6
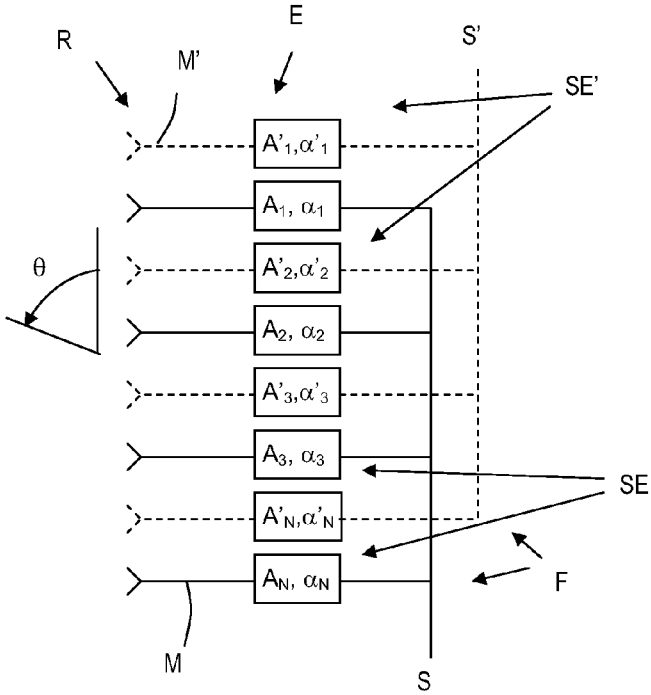
FIG. 7

OPTIMIZED RADIATION PATTERNS

FIELD OF THE INVENTION

The present invention relates to means and methods for providing optimized antenna radiation patterns in a network. The invention concerns antenna arrangements in which a number of data streams may be transmitted or received. One example is wireless Multiple Input Multiple Output (MIMO) or space multiplexing (SM) communication systems, another is systems utilising transmit and receive diversity techniques. The invention moreover concerns antenna arrangements offering improved coverage.

BACKGROUND OF THE INVENTION

It is well known that dual polarized antennas may be used for communication via channels with different fading statistics, thereby better utilizing the available spectrum in a wireless network.

It is also known that MIMO systems may increase the data rate in wireless communication systems where the available channel bandwidth is fixed. In MIMO applications, a given data stream is split into a number of individual data streams and transmitted over a common frequency band using multiple antennas at the base-station and the user equipment. In a fading environment characterized by multi-path propagation, each transmission path will be subject to different fading characteristics, which may be estimated by means of transmitted pilot sequences or reference signals. This property is utilised in a MIMO reception system to resolve the individual data streams. In order for the MIMO system to work properly, the magnitude of the correlation p between the signals that are communicated via the channels exploiting the antenna arrangement must be sufficiently low, typically below 0.7. A common way to achieve low-correlated data streams is to use spatially separated antennas that experience different channel fading statistics. An alternative option is to transmit/receive the different data streams utilising antennas of orthogonal polarizations. Multimode antennas where each mode has a different radiation pattern is yet another technique [T. Svantesson, "Correlation and channel capacity of MIMO systems employing multimode antennas", IEEE Trans. on Vehicular Technology, Vol. VT-51, pp. 1304-1312, November 2002].

FIG. 1 shows three antenna arrays M, M' and M" being arranged with a distance, d, between one another, all radiating elements having the same polarization. FIG. 2 and FIG. 3 show other more compact configurations wherein two arrays M and M' are interleaved and arranged on a line but where the elements of one array M have an orthogonal polarization in relation to the elements of the other antenna array M'. In FIG. 4, a fourth configuration is shown having two separated antenna arrays M and M', wherein all radiating elements of a particular array are oriented in the same direction and hence have the same polarization, but where the elements of the two arrays are orthogonally polarized in relation to one another. In a fifth, FIG. 5, and a sixth, FIG. 6, configuration, the two antenna arrays are co-located employing dual-polarized radiating elements with common phase centers for the two polarizations. Other configurations include a plurality of single or dual polarized antenna arrays or a combination thereof placed side by side or aligned above each other.

For the configuration examples in FIGS. 1-6, excitation weighting networks shown in FIG. 7 may be provided that have a magnitude weight, A, and a phase or delay weight, $\alpha$, for each radiating element, the magnitude weights, and delay weights also being denoted excitation weights or excitation means. It is understood that the delay weights can be implemented as true time delay weights or as phase weights between 0 and 360 degrees or a combination thereof. The former implementation with only true time delay weights gives a more broadband system compared to only a phase weight implementation. By assigning various values to the individual excitation weights, various effects may be accomplished such as to direct the main beam of the antenna at a desired angle $\theta$ with regard to the antenna array, to control the side-lobe level, and to shape the radiation pattern. In several prior art antenna array systems, the magnitude weights and the delay weights of N radiating elements are chosen such that $A_n = A'_n$ and $\alpha_n = \alpha'_n$, where n is from 1 to N, that is the respective antenna arrays are identical with regard to the excitation means of the same respective position in the arrays for diversity transmission or reception.

U.S. Pat. No. 6,282,434 shows a method for providing quality improvement by applying different antenna radiation amplitude patterns by mechanically or electronically down-tilting the receive antenna array at a different angle in relation to the transmit antenna array. The electronically down-tilted beam is accomplished by applying only different phase weights to the radiating elements of the receive array such that a linear progressive phase shift between the radiating elements is achieved.

Many state-of-the-art base-station antenna installations make use of spaced apart antenna arrays as shown in FIG. 1. Some installations are dual-polarized as shown in FIGS. 2-6. Such antenna arrays may infer a correlation between the received signals due to radiation pattern de-polarization. The correlation between signals received in the dual-polarized beams is usually very low within the angular region of the main beam. However, in the side-lobe region, the correlation may increase, especially for the dual-polarized or closely spaced antenna configurations shown in FIGS. 1-6. This may be disadvantageous for high data rate capable mobile terminals that are located close to the base-station and therefore communicating via the side-lobe angular region in the base-station antenna radiation pattern.

One problem associated with prior art antenna arrangements is that the conditions for transmit and receive diversity applications or MIMO applications are not sufficiently fulfilled.

Another problem associated with known antenna systems is that close to a base-station there may be service areas with reduced field strength due to nulls in the side-lobe region of the antenna radiation amplitude pattern.

SUMMARY OF THE INVENTION

It is a primary object of the invention to set forth an antenna arrangement which decreases the correlation between transmitted signals or received signals of the antenna arrangement or which improves coverage within a given service area or which provides a combination of the two.

This object has been accomplished by an antenna arrangement comprising at least two antenna arrays, each array comprising a plurality of radiating elements being arranged so as to have at least a plurality of corresponding radiating element positions, wherein for each radiating element there is associated an excitation means comprising a magnitude weight and a delay weight, wherein there is a first set of excitation means associated with a first array providing a first radiation pattern and a second set of excitation means associated with a second array associated with a second radiation pattern. Given excitation means of a given set may have differing delay weights, wherein at least two respective excitation means associated with a corresponding radiating element position of at least two respective arrays have at least two different magnitude weights, and at least two respective excitation means associated with a corresponding radiating element position of at least two respective arrays have at least two different delay weights and wherein the excitation weights of the at least first and second sets of excitation means are selected so that the main beam directions of the at least two antenna arrays essentially coincide and so that at least the correlation coefficient associated with respective signals communicated over the at least first and second array have a magnitude of the correlation coefficient below 0.7 in a given side-lobe region, or so that the radiation amplitude patterns associated with the at least first and second set of excitation means have an envelope with a substantial null-fill difference in a given side-lobe region with regard to the main beam peak.

According to one aspect of the invention, the first set of excitation means corresponding to the first array and the second set of excitation means corresponding to the second array are chosen such that the amplitude patterns of the first and second radiation patterns are essentially equal.

According to a further aspect, the roots associated with the first and second sets of excitation means are equal in numbers, whereby any given root associated with the first excitation set is associated with a corresponding root of the second excitation set, wherein at least two corresponding roots of the first and second excitation sets are displaced with regard to one another.

According to a further aspect of the invention, the at least one pair of corresponding roots associated with the first set and second set of excitation means are positioned off the Schelkunoff unit circle, such that the phase patterns are made different across the side-lobe region of interest for providing a low signal correlation.

In one embodiment of the invention, at least two corresponding roots are displaced angularly from one another while still being situated on the common Schelkunoff unit circle, whereby the nulls of the respective radiation patterns do not overlap in the side-lobe region of interest for providing improved coverage.

According to a further aspect of the invention, the radiation amplitude patterns associated with the at least first and second set of excitation means have envelopes with a null-fill difference in a given side-lobe region less than or equal to 25 dB below the main beam peak.

According to a further aspect of the invention, at least one root of the first set of excitation means is displaced in a clockwise direction on the unit circle and at least one root of the second set of excitation means is displaced in a counter clockwise direction.

Advantageously, the first set of excitation means are adapted for transmitting or receiving a first signal and the second set of excitation means are adapted for transmitting or receiving a second signal or a combination thereof.

Among the benefits of the invention are that the at least two signals may be associated with data in a Multiple Input Multiple Output communication system. The low signal correlation optimizes operation of such data transmissions.

The at least two signals may also be associated with data in a transmit or receive diversity communication system.

Further advantages will appear from the following detailed description of the invention.

DETAILED DESCRIPTION OF THE FIGURES

Figure 8B:
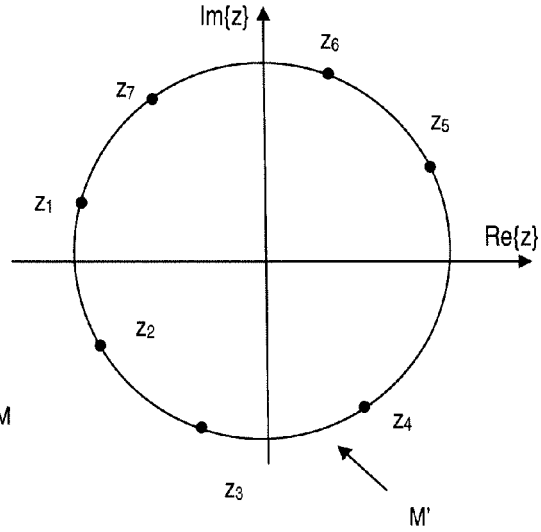
Figure 9:
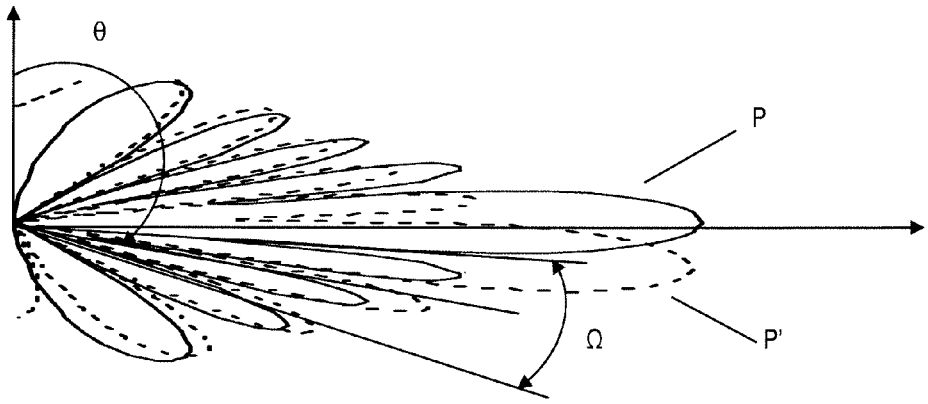
Figure 10:
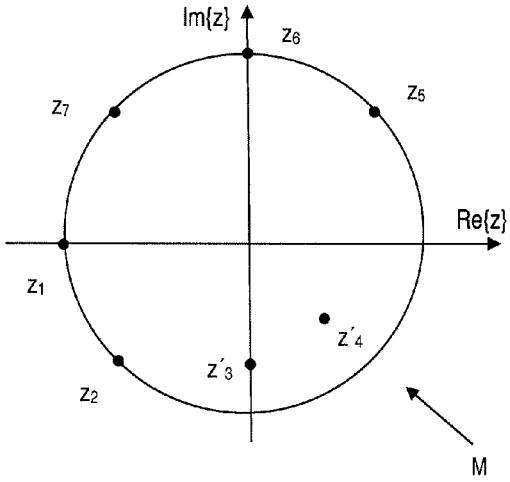
Figure 11:
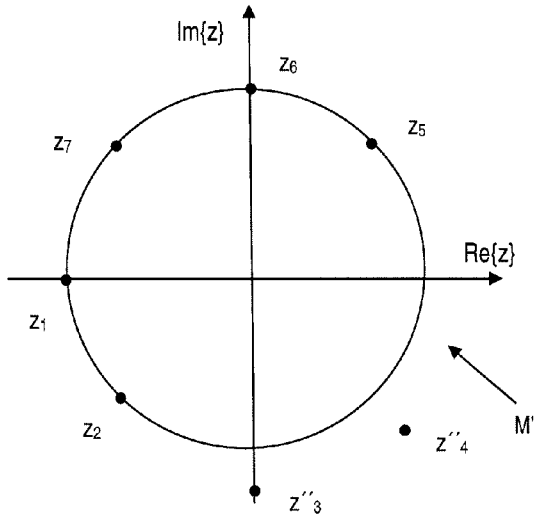
Figure 12:
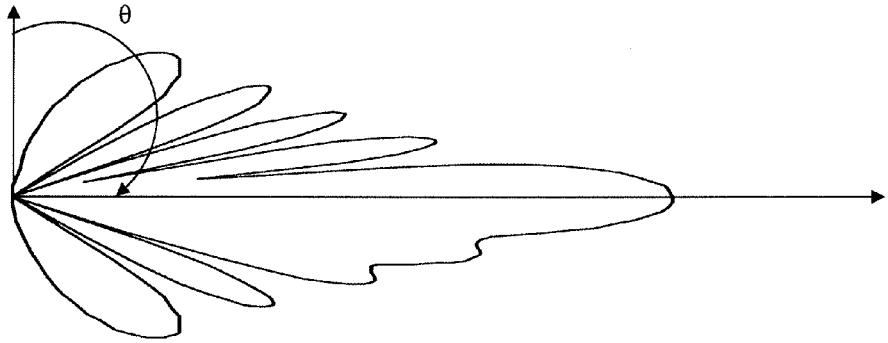
Figure 13:
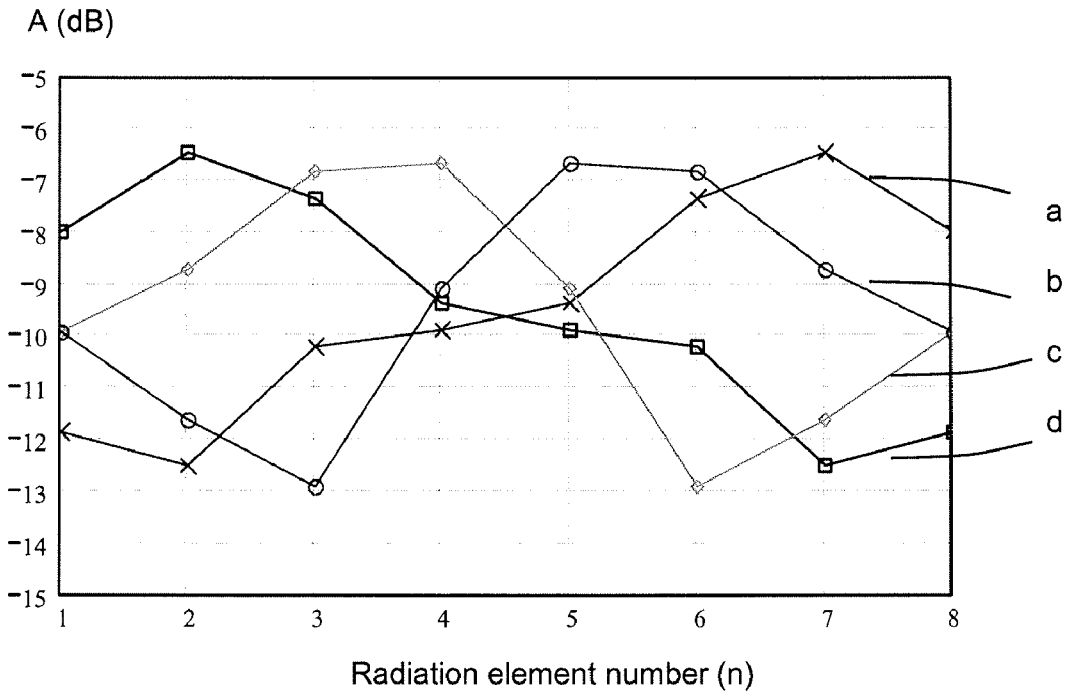
Figure 14:
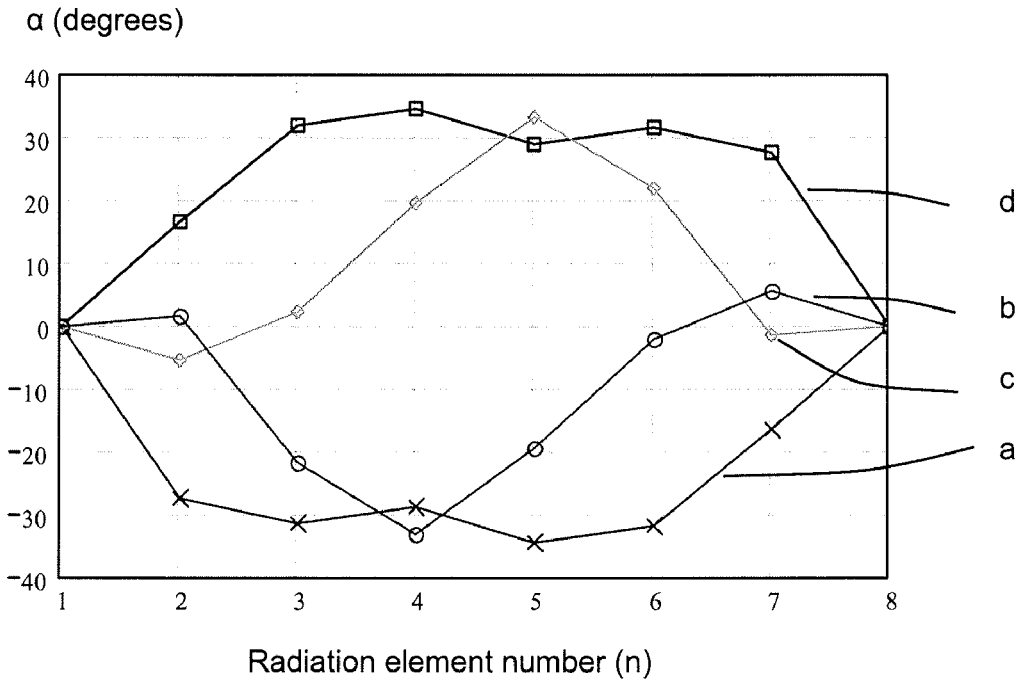
Figure 15:
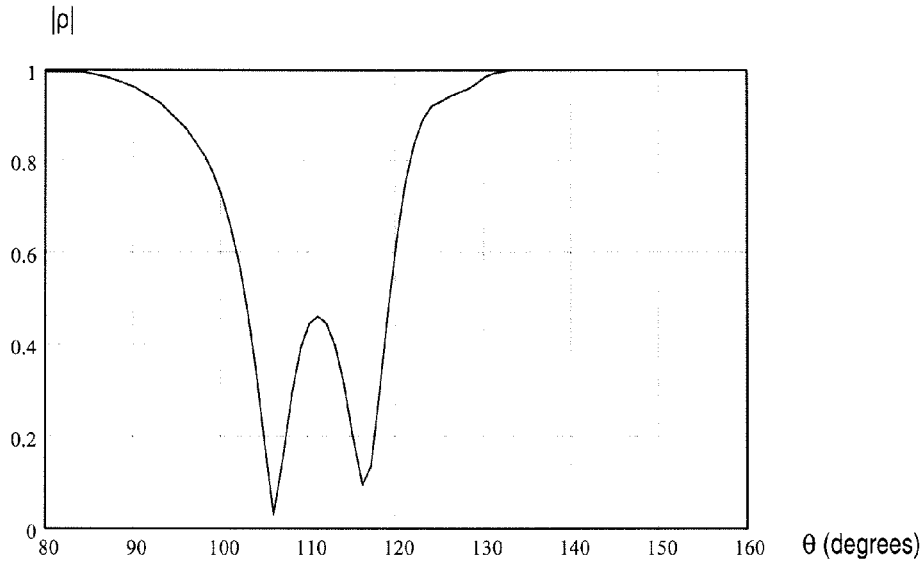
Figure 16:
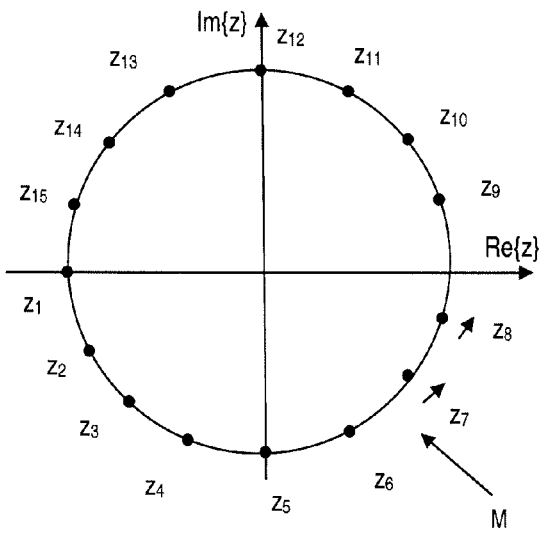
Figure 17:
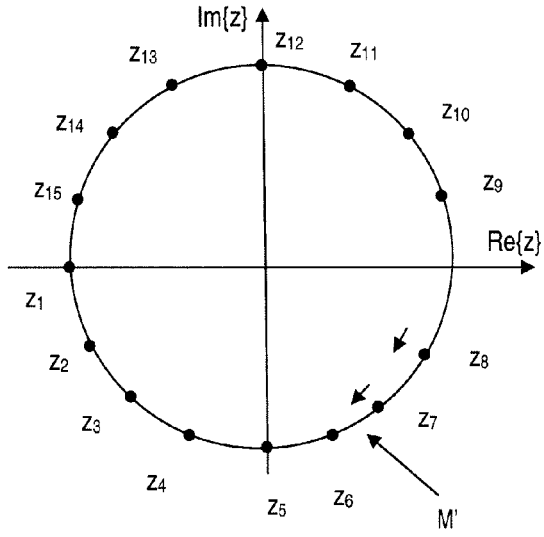
Figure 18A:
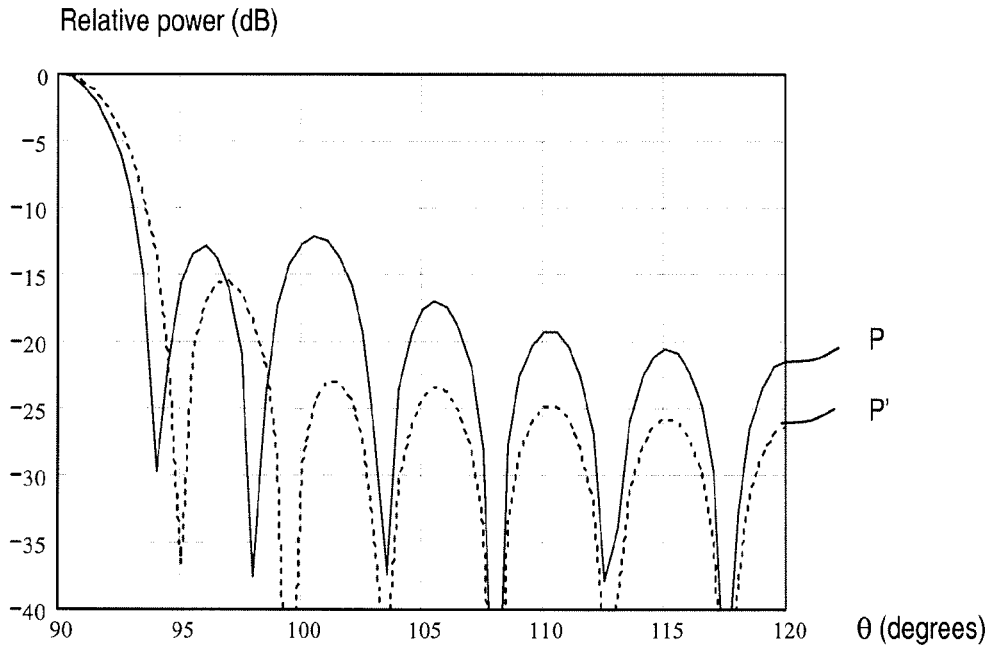
Figure 18B:
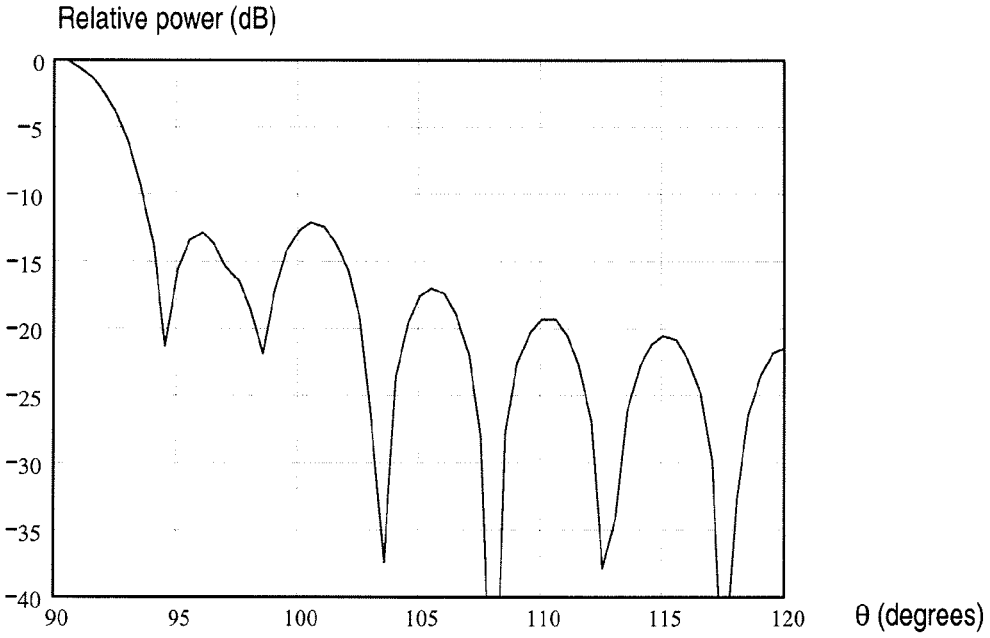
Figure 19:
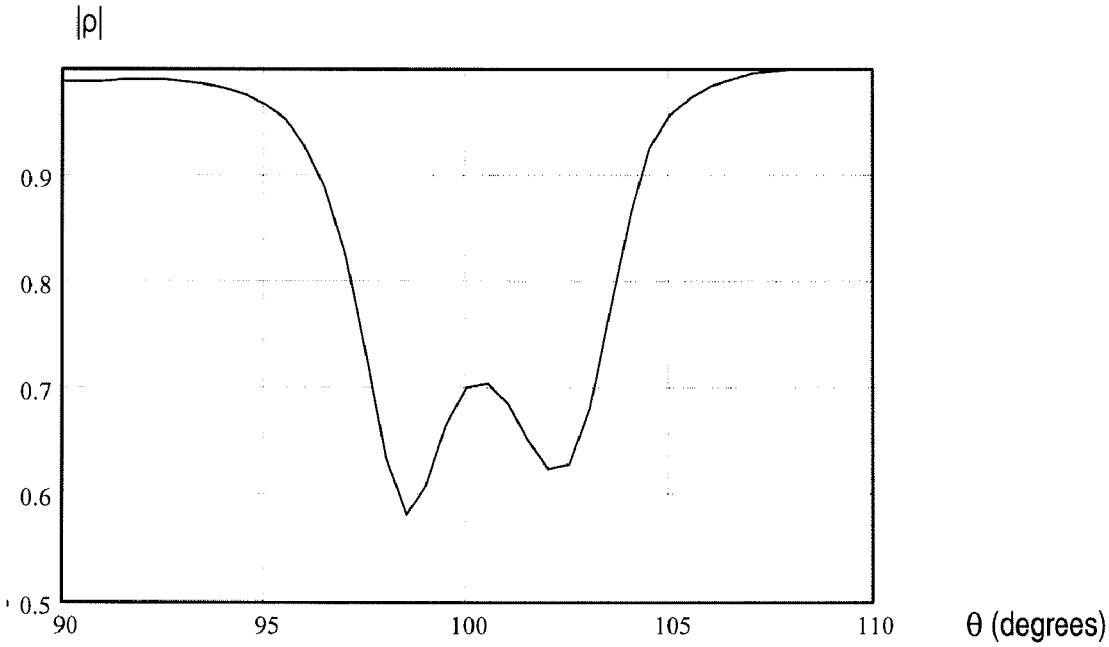

FIG. 1 shows a first known configuration of three spatially separated antenna arrays M, M' and M", FIG. 2 shows a second known configuration of two interleaved orthogonally polarized antenna arrays forming a linear array, FIG. 3 shows a third known configuration of two interleaved orthogonally polarized antenna arrays forming a linear array, FIG. 4 shows a fourth known configuration of two spatially separated orthogonally polarized antenna arrays, FIG. 5 shows a fifth known configuration of a dual-polarized antenna array, FIG. 6 shows a sixth known configuration of a dual-polarized antenna array, FIG. 7 shows a schematic drawing of networks providing excitation weighting of the arrays of radiating elements in FIGS. 2-6, FIG. 8*a* shows roots on the Schelkunoff unit circle associated with the radiation pattern for an eight element linear antenna array, FIG. 8*b* shows the corresponding roots on the Schelkunoff unit circle associated with the radiation pattern for the antenna array shown in FIG. 8*a* at a given beam-tilt angle, FIG. 9 shows the radiation amplitude patterns for the antenna arrays having the roots shown in FIGS. 8*a*, and 8*b*, respectively, FIGS. 10 and 11 show roots on the Schelkunoff unit circle associated with the radiation pattern for a pair of respective eight element linear antenna arrays M and M' according to a first embodiment of the invention for an antenna arrangement, FIG. 12 shows the radiation amplitude pattern for the antenna array according to the first embodiment of the invention having the root configurations shown in FIGS. 10 and 11, FIG. 13 shows magnitude weight values of exemplary sets of excitation means a)-d) for an eight element array antenna arrangement, wherein the combination a) and d) corresponds to the first embodiment of the invention, FIG. 14 shows delay weight values of the exemplary sets of excitation means a)-d) indicated in FIG. 13, FIG. 15 shows the magnitude of the correlation, p, across the side-lobe region of interest for the first embodiment of the invention, FIGS. 16 and 17 show roots on the Schelkunoff unit circle associated with the radiation pattern for a pair of respective 16 element linear antenna arrays M and M', with modified excitation weights, according to a second embodiment of the invention, FIG. 18*a* shows radiation amplitude patterns, P and P', of the pair of antenna arrays M and M', respectively, for the second embodiment of the invention, FIG. 18*b* shows envelope pattern of the radiation amplitude patterns in FIG. 18*a*, and FIG. 19 shows the magnitude of the correlation, p, across the side-lobe region of interest for the second embodiment of the invention.

DETAILED DESCRIPTION OF PREFERRED EMBODIMENTS OF THE INVENTION

First Embodiment of the Invention

The present invention may be realised for a number of different antenna configurations for instance as shown in FIGS. 1-6. The respective antenna arrays may be spatially separated or dual-polarized or a combination thereof and preferably identical with regard to the number, N, of radiating elements.

It is well known that the array factor, AF, of an antenna array with N radiating elements can be expressed as a product of (N−1) linear terms, c.f. C. A. Balanis, Antenna theory: Analysis and design, second edition, John Wiley & Sons, New York, 1982, pp. 342-346:

$$AF(z)=a_N(z-z_1)(z-z_2)(z-z_3)\quad .\quad .\quad .\quad (z-z_{N-1})=a_1+a_2z+\ldots+a_Nz^{N-1}$$

where $z=\exp(jkd\cos\theta)$, and $z_1, z_2, z_3, z_{N-1}$ are the roots of the array factor and whereby the radiating element excitation weights $a_n$ are complex numbers of magnitude $A_n$ and phase angle $\alpha_n$, n=1, 2, 3, . . . N. The radiating element spacing is denoted d, the propagation constant is k and θ is the angle from the antenna array axis.

The radiation pattern of an antenna array is determined by the vector addition of the fields radiated by the individual radiating elements. The total field of an antenna array with identical radiating elements, neglecting mutual coupling effects, is then given by the product of the element radiation pattern and the array factor. The side-lobe level and the null locations in the antenna array radiation pattern are mainly determined by the array factor and therefore only the array factor is considered in the following.

The excitation weighting networks shown in FIG. 7 can be implemented in hardware by using standard amplitude, phase, and delay elements, such as amplifiers, power splitters, power combiners, phase shifters and true time delay lines, as well as in software, whereby equivalent effects with regard to signal amplification, ($A_n$ and $A'_n$) and phase/delay ($a_n$ and $a'_n$) are obtained at baseband. It should furthermore be noticed that these excitation means could be implemented as fixed weights or adaptively adjustable weights.

For the case when all excitation weights are equal, that is, $A_n=A'_n=A_N$ and $\alpha_n=\alpha'_n=\alpha_N$, where n is from 1 to N, the roots fall on a unit circle, the so called Schelkunoff unit circle. This is illustrated in FIG. 8*a*, for a linear antenna array of eight radiating elements.

The corresponding radiation amplitude pattern versus the angle θ from 0 to 180 degrees is shown in FIG. 9 (solid line) for the case when the radiating elements are spaced 0.625 wavelengths apart. The main beam is pointing towards the horizon (θ=90 degrees). As can be seen, four radiation amplitude pattern nulls, associated with roots on the Schelkunoff unit circle, are formed below the horizon at about 12 degrees, 24 degrees, 37 degrees and 52 degrees from the main beam peak.

It is further known that the correlation between two signals S and S' received by the antenna arrays M and M' with respective associated excitation weights and array factors $AF_1$ and $AF_2$, respectively, can be found according to the following expression (omitting the element radiation pattern) [R. G. Vaughan and J. Bach Andersen, "Antenna diversity in mobile communications", IEEE Trans. on Vehicular Technology, Vol. VT-36, pp. 149-172, November 1987].

$$\rho=\frac{\int AF_1(\Omega)AF_2^*(\Omega)S(\Omega)d\Omega}{\sqrt{\int|AF_1(\Omega)|^2S(\Omega)d\Omega}\sqrt{\int|AF_2(\Omega)|^2S(\Omega)d\Omega}}$$

where S(Ω) is the power distribution function of the incident field at the receive antenna arrays and the asterisk denotes the complex conjugate. The same expression is valid on transmit due to reciprocity.

According to a first embodiment of the invention, at least one pair of radiation patterns having a sufficiently low pairwise correlation are generated by positioning at least one of the roots, shown in FIG. 8*a*, off the Schelkunoff unit circle. Moreover, the main beam directions coincide and the associated radiation amplitude pattern nulls are "filled".

In the first embodiment of the invention, N1 roots, where N1 equals a number from 1 to N−1, have been positioned off the Schelkunoff unit circle and the corresponding nulls in the radiation amplitude pattern have been filled. Each one of the N1 roots that lies off the Schelkunoff unit circle can be positioned either inside or outside the unit circle. In general, there are $2^{N1}$ unique sets of root configurations available that generate the same radiation amplitude pattern but different phase pattern [H. J. Orchard, R. S. Elliott and G. J. Stern, "Optimising the synthesis of shaped beam antenna patterns", IEE Proc., Pt. H, Vol. 132, pp. 63-68, February 1985].

According to a first embodiment of the invention, there is provided antenna arrays M and M' arranged in the same manner as shown in any of FIGS. 1-6, except for the number of arrays being restricted to two. It should be noted that the invention and the first embodiment of the invention are also applicable to more than two arrays. Hence, two similarly polarized (co-polarized), or orthogonally polarized, or spatially separated antenna arrays, or combinations thereof are provided.

Each antenna array has equal number of radiating elements R and the arrangement comprises excitation weighting networks F as shown in FIG. 7. The network comprises an excitation means E for each radiating element R in the antenna arrays M, M'. Depending on the application, unique signals S, S', may be provided or a common signal may be provided to the respective antenna arrays for transmission or reception over the antenna arrangement.

For the first antenna array M with eight radiating elements, as an example of the first embodiment, the two nulls closest to the main beam below the horizon have been "filled" by positioning the associated roots $z_3$ and $z_4$ radially inside the Schelkunoff unit circle, denoted $z'_3$ and $z'_4$ respectively, see FIG. 10, hence modifying the excitation weights in relation to the reference design example shown in FIG. 8*a*. The corresponding radiation amplitude pattern, associated with the modified excitation weights and with two filled nulls, is shown in FIG. 12. In this example, with two displaced roots, there are four possible unique sets of root configurations to generate four identical radiation amplitude patterns but with different phase pattern.

For the second antenna array M', another set of excitation weights is used which preferably produce an essentially identical radiation amplitude pattern as that shown in FIG. 12, but with a different phase pattern. This set of excitation weights is found by geometrical inversion of one or more of the N1 displaced roots in the Schelkunoff unit circle, that is $|z'_n|\cdot|z''_n|=1$, see FIG. 11. This inversion relation is used for the second antenna array M' of the first embodiment, whereby roots $z_3$ and $z_4$, c.f. FIG. 8*a*, both have been positioned outside the unit circle to positions $z''_3$ and $z''_4$, respectively. The absolute values of the roots are inverted as compared to the two roots $z'_3$ and $z'_4$ in FIG. 10, while the phase angles remain unchanged.

For the antenna arrangement above, the two radiation patterns have similar amplitude patterns but different phase patterns in order to reduce the correlation between the signals by weighting the antenna excitation means differently for the beams covering the same angular region of interest. This is advantageous for diversity transmission and reception, and MIMO transmission and reception, whereby wireless communication can be secured and in some instances enhanced.

Additional alternative radiation patterns with identical radiation amplitude patterns as shown in FIG. 12, but with different phase patterns may also be found by inverting only one of the displaced roots, for instance either $z'_3$ to $z''_3$ or $z'_4$ to $z''_4$ in the example above.

The magnitude of the relative excitation weights are given in FIG. 13 for four exemplary root configurations a), b), c) and d) for the example given with an eight element antenna array and with two roots displaced off the Schelkunoff unit circle. Option a) corresponds to positioning both $z_3$ and $z_4$ inside, b) corresponds to positioning $z_3$ outside and $z_4$ inside, c) corresponds to positioning $z_3$ inside and $z_4$ outside, and d) corresponds to positioning both $z_3$ and $z_4$ outside the Schelkunoff unit circle, respectively. The corresponding relative delay weights, $a_n$, of configurations a)-d) are shown in FIG. 14.

According to the first embodiment of the invention, the excitation weights are formed according to antenna array M being configured according to the a) option, while the M' antenna array is configured according to the d) option, see FIGS. 10-11, or vice versa. For the first embodiment, (excitation weights according to sets a) and d) in FIGS. 13 and 14) the magnitude of the correlation is 0.82 for angles between 0 and 180 degrees assuming a uniform distribution of incoming waves (S=1 from θ=0 degree to 180 degrees).

In the angular region of interest, the side-lobe region, the magnitude of the correlation is reduced since that region is affected by the displaced roots and corresponding nulls are filled. The magnitude of the correlation within a 15-degree sliding window in the side-lobe region of interest is presented in FIG. 15 for the above example with eight radiating elements and two displaced roots (FIGS. 10 and 11). It is assumed that the power distribution function of the incident field, S, (i.e., the assumed angular spread of the incident waves) equals 1 from $\theta_0$−7.5 degrees to $\theta_0$+7.5 degrees and equals zero otherwise, when $\theta_0$ varies from 0 to 180 degrees.

Two data streams S and S', unique or identical, are provided to antenna arrays M and M', (respectively), for the antenna arrangement described above when using the antenna arrangement in MIMO, or transmit and receive diversity applications, respectively. For obtaining a good performance, it is required that the correlation p between pair-wise received signals by the antenna arrays is sufficiently low, typically $|\rho|<0.7$.

Within the angular region of the main beam, the required low correlation between S and S' is achieved by using orthogonal polarization or by spatially separating the antenna arrays. In the side-lobe angular region of interest, the excitation weights of the antenna arrays are, as discussed above, used to decrease the correlation by selecting a proper set of excitation weights for the radiating elements in each antenna array.

According to the invention, a sufficiently low correlation can be accomplished in different ways. In table 1 below, various combinations of the root configurations shown in FIGS. 10 and 11 are provided, whereby the roots have been selected in various combinations for the eight element antenna array—the two-array antenna arrangement example described previously. Table 1 shows the magnitude of the respective correlation values for six different root displacement combinations using the sets of excitation weights indicated in FIGS. 13 and 14, whereby those root combinations having a sufficiently low value correspond to alternative examples of the first embodiment of the invention.

The incident field distribution is assumed to be uniform (S=1) within the angular region in θ from 100 degrees to 115 degrees and zero otherwise. The lowest magnitude of the correlation is achieved when the selected roots of the two radiation patterns are displaced at opposite sides of the Schelkunoff unit circle and the excitation weights are chosen such that $A_n=A'_{N+1-n}$ and $\alpha_n=-\alpha'_{N+1-n}$ for n=1 to N, which is clear from FIGS. 13 and 14.

TABLE 1

Magnitude of the correlation for an eight element antenna arrangement example with six combinations of two displaced roots.

| Excitation | M | | M' | | $\lvert\rho\rvert$ |
|---|---|---|---|---|---|
| option M, M' | $z'_3$ | $z'_4$ | $z''_3$ | $z''_4$ | (θ = 100°-115°) |
| a, d | inside | inside | outside | outside | 0.23 |
| c, d | inside | outside | outside | outside | 0.81 |
| a, c | inside | inside | inside | outside | 0.56 |
| a, b | inside | inside | outside | inside | 0.81 |
| b, c | outside | inside | inside | outside | 0.74 |
| b, d | outside | inside | outside | outside | 0.56 |

As stated above, MIMO, transmit diversity, and receive diversity applications typically require a correlation $|\rho|<0.7$ between signals to work properly. It is noticed that quite large variations in the correlation value appear and that not all options in the table are usable for MIMO, transmit diversity or receive diversity applications. If the desired correlation value should be below $|\rho|<0.7$, the combinations a, d; a, c; and b, d in the table above constitute alternatives to the example above of the first embodiment of the invention, while combinations c, d; a, b and b, c do not provide the desired correlation value. The lowest value of $|\rho|$ in this example is represented by excitation option a, d.

As appears from the above table not all results would be useable with regard to correlation values for MIMO, transmit diversity, or receive diversity applications. This means that the designer would typically perform a number of design steps in order to find those particular root configurations that give the desired result. From the acceptable root configurations a given set of excitation weights can be calculated in a known manner. Some excitation weights may be impossible or disadvantageous to implement why another configuration may be evaluated. Hence the dimensioning/selection of excitation weights is an iterative procedure.

The realized correlation value depends on the antenna radiation pattern, the number of radiating elements, polarization of the antenna arrays, the element spacing, the antenna excitation weights, the angular spread of the incident waves, the propagation environment and where in the given environment the antenna arrangement is located.

It is understood that any number of roots between one and seven (for the example given above with eight radiating elements) may be positioned off the Schelkunoff unit circle.

The corresponding radiation amplitude pattern would then exhibit one or more filled nulls, as there is a one-to-one relation between the nulls in the radiation pattern and the corresponding roots on the Schelkunoff unit circle.

According to the first embodiment of the invention, there is provided at least two radiation patterns of a dual-polarized or spaced-apart antenna arrangement comprising arrays M and M', the arrays having excitation weighting networks for providing essentially the same radiation amplitude pattern and thereby covering essentially the same service area but the excitation networks generating different phase patterns in order to reduce the signal correlation in the side-lobe angular region of interest and/or in order to fill the nulls in the service area.

It should be understood that the number of radiating elements can be more or less compared to the example described above with eight radiating elements in each antenna array.

Alternative realizations of the first embodiment involve displacing only one root or more than two roots. This results in filling only one or more than two nulls, respectively, in the corresponding radiation amplitude pattern.

Hence, according to the first embodiment of the invention there is provided an antenna arrangement comprising at least two antenna arrays (M, M', M"), each array comprising a plurality (N) of radiating elements (R) being arranged so as to have at least a plurality of corresponding radiating element positions, wherein for each radiating element there is associated an excitation means (E) comprising a magnitude weight (A) and a delay weight (a), wherein there is a first set (SE) of excitation means (E) associated with a first array (M) providing a first radiation pattern and a second set (SE') of excitation means (E) associated with a second array (M') providing a second radiation pattern, and wherein given excitation means (E) of a given set may have differing delay weights ($\alpha_n$; $\alpha_{n+x}$), wherein at least two respective excitation means (E) associated with a corresponding radiating element position of at least two respective arrays (M, M', M") have at least two different magnitude weights ($A_n$, $A'_n$, $A''_n$), and at least two respective excitation means (E) associated with a corresponding radiating element position of at least two respective arrays (M, M', M") have at least two different delay weights ($\alpha_n$, $\alpha'_n$, $\alpha''_n$) and wherein the excitation weights ($A_n$, $A'_n$, $A''_n$; $\alpha_n$, $\alpha'_n$, $\alpha''_n$) of the at least first and second sets of excitation means (SE, SE') are selected so that the main beam directions of the at least two antenna arrays essentially coincide and so that at least the correlation coefficient ($\rho$) associated with respective signals (S, S') communicated over the at least first and second array (M, M', M") have a magnitude correlation coefficient below 0.7 in a given side-lobe region.

Advantageously, the corresponding roots ($z_n$, $z'_n$) of the first set (SE) of excitation means corresponding to the first array (M) and the second set of excitation means (SE') corresponding to the second array (M') may be chosen such that the amplitude patterns (P, P') of the first and second radiation patterns are essentially equal.

Moreover, the roots associated with the first and second sets of excitation means (SE, SE') may be equal in numbers, whereby any given root (z) for the first excitation set (SE) is associated with a corresponding root (z') of the second excitation set (SE'). At least two corresponding roots (z, z') of the first and second excitation sets are displaced with regard to one another. The at least two corresponding roots of the first set and second set (SE, SE') may be positioned off the Schelkunoff unit circle, such that the phase patterns are made different across the side-lobe region of interest for providing a low signal correlation.

Moreover, at least two additional corresponding roots of the first set and second set (SE, SE') are positioned off the Schelkunoff unit circle. The roots positioned off the Schelkunoff unit circle of the first set may respectively be positioned inside and may respectively be positioned outside the Schelkunoff unit circle.

At least two corresponding roots may be geometrically imaged in relation to one another with respect to a point on the common Schelkunoff unit circle. The imaging can correspond to the two corresponding roots being geometrically inverted with regard to the Schelkunoff unit circle. The remaining roots of the first and second excitation sets are arranged on the Schelkunoff unit circle. The remaining roots of the first and second excitation sets can be arranged on the same respective positions on the Schelkunoff unit circle.

It should further be understood that the invention is also applicable to single and dual-polarized antenna arrangements having more than two antenna arrays, for instance three such as shown in FIG. 1. The invention moreover is not only restricted to an equal antenna array separation d, nor to transmit—receive communication systems having unequal number of antenna arrays at both ends. In such cases, it is advantageous that the correlation between any two signals is as low as possible. It is however not necessary to find a global minimum, typically a correlation $|\rho|<0.7$ between signals is sufficient. It should furthermore be emphasised that the number of data streams, unique or equal, is not restricted to two.

It should furthermore be understood that the first embodiment is also applicable to applications in which the radiation patterns are electrically beam-tilted, by which the associated root configurations are rotated (in angular direction) along the Schelkunoff unit circle, cf. FIGS. 8*a* and 8*b*, wherein also one or more roots are located off the Schelkunoff unit circle. For such an installation, it is understood that the service area of the two antenna arrays are the same and the object of establishing a sufficiently low correlation value is met.

It should moreover be understood that the first embodiment can be implemented in both elevation and in azimuth.

It should further be understood that the antenna arrangement can be used for transmission or reception of signals as well as a combination thereof.

One advantage with the antenna arrangement above is that signal correlation is reduced within a service area to improve transmit diversity, receive diversity and MIMO applications. This is accomplished by appropriately designing the radiation patterns of the antenna arrays versus the angle seen from the antennas so that the radiation amplitude patterns are essentially equal but the phase patterns differ.

Another advantage with the above antenna arrangement is that coverage is increased within a service area. This is achieve by appropriately designing the radiation amplitude pattern versus the angle seen from the antenna arrays so as to "filling the first nulls", that is, increasing the magnitude of local field strength at the minima in the radiation amplitude patterns.

Yet another advantage of the first embodiment is that the coupling between the antenna arrays is reduced which reduces filter (not shown) requirements. A reduction in the signal correlation implies a reduced antenna mutual coupling since the mutual resistance is closely related to the correlation [R. G. Vaughan and J. Bach Andersen, "Antenna diversity in mobile communications", IEEE Trans. on Vehicular Technology, Vol. VT-36, pp. 149-172, November 1987].

Second Embodiment of the Invention

As mentioned above, the radiation amplitude patterns for a dual-polarized base-station antenna array should usually be identical in order to cover the same service area. This means that the beam peaks as well as the nulls of the two radiation amplitude patterns have the same angular dependence. In MIMO, and for transmit diversity and receive diversity applications, it is advantageous if the null directions in the two radiation amplitude patterns do not coincide.

According to a second embodiment of the invention, an exemplary antenna array comprising at least two antenna arrays M and M' is provided. The link budget in the side-lobe region of interest can be significantly improved by moving the roots on the Schelkunoff unit circle differently and preferably oppositely for the two corresponding radiation amplitude patterns so that the associated nulls do not coincide. According to the second embodiment of the invention, the two different radiation patterns are generated by moving one or more roots in different angular directions along the Schelkunoff unit circle for the two radiation patterns.

According to the second embodiment of the invention shown in FIGS. 16 and 17, an exemplary antenna array comprising two antenna arrays M and M' with 16 radiating elements each, are provided. The 15 roots fall on the Schelkunoff unit circle in a similar manner as shown in FIG. 8*a*, except for the increased number of roots. In the modified radiation patterns according to the second embodiment of the invention, the two roots, $z_7$ and $z_8$, associated with the two nulls closest to the main beam below the horizon have been moved—as indicated by the arrows—such that the corresponding null directions in the radiation amplitude patterns of the two arrays, M and M', do not coincide outside the main beam.

For the first array M, the two roots have been moved in an angular direction along the Schelkunoff unit circle towards the corresponding main beam peak and for the second array M', the two roots are moved in an angular direction along the Schelkunoff unit circle away from the corresponding main beam peak. The radiation amplitude patterns with modified nulls are shown in FIG. 18*a*. The envelope of the two amplitude patterns is obtained by applying maximum {P, P'} for all angles θ. The resulting envelope pattern for this example is shown in FIG. 18*b*, in turn resulting in an improved link budget in the side-lobe region of interest below the horizon.

For the example given, the nulls in the radiation amplitude pattern do not coincide any longer since the roots have been re-positioned. In order to achieve a sufficient link budget in the side-lobe region of interest, the difference between the envelope pattern and the main beam peak should not be more than 25 dB, i.e., the envelope null-fill difference in a given side-lobe region should be less than or equal to 25 dB below main beam peak.

At the first and second nulls in FIG. 18*a*, the envelope of the null-fill difference of the radiation amplitude patterns of the two antenna arrays M and M' is less than or equal to 25 dB below the main beam peak. Thereby, the coverage in the side-lobe region of interest has been significantly improved.

The magnitude of the correlation in the angular region of the side-lobes where the nulls in the radiation amplitude patterns do not coincide is presented in FIG. 19. The correlation is calculated within a 10-degree sliding window, i.e., the power distribution function of the incident field, S, equals 1 from $\theta_0-5$ degrees to $\theta_0+5$ degrees and equals zero otherwise, when $\theta_0$ varies from 0 to 180 degrees. As appears, the magnitude of the signal correlation is below 0.7 in the angular region of about 98-103 degrees.

The two radiation patterns may for example be created by two spatially separated antenna arrays with similar or different polarizations following the general outline of FIGS. 1 and 4, respectively, or in the same antenna unit with orthogonal polarizations, e.g., 0/90 degrees or ±45 degrees as shown in FIGS. 2, 3, 5 and 6. The dual-polarized antenna arrays may include power splitters/combiners to generate another set of two orthogonal polarizations.

Hence, there is provided an antenna arrangement comprising at least two antenna arrays (M, M', M''), each array comprising a plurality (N) of radiating elements (R) being arranged so as to have at least a plurality of corresponding radiating element positions, wherein for each radiating element there is associated an excitation means (E) comprising a magnitude weight (A) and a delay weight (a), wherein there is a first set (SE) of excitation means (E) associated with a first array (M) providing a first radiation pattern and a second set (SE') of excitation means (E) associated with a second array (M') providing a second radiation pattern, and wherein given excitation means (E) of a given set may have differing delay weights ($\alpha_n$; $\alpha_{n+x}$), wherein at least two respective excitation means (E) associated with a corresponding radiating element position of at least two respective arrays (M, M', M'') have at least two different magnitude weights ($A_n$, $A'_n$, $A''_n$), and at least two respective excitation means (E) associated with a corresponding radiating element position of at least two respective arrays (M, M', M'') have at least two different delay weights ($\alpha_n$, $\alpha'_n$, $\alpha''_n$) and wherein the excitation weights ($A_n$, $A'_n$, $A''_n$; $\alpha_n$, $\alpha'_n$, $a''_n$) of the at least first and second sets of excitation means (SE, SE') are selected so that the main beam directions of the at least two antenna arrays essentially coincide and so that at least the radiation amplitude patterns (P, P') associated with the at least first and second set of excitation means have an envelope with a substantial null-fill difference in a given side-lobe region with regard to the main beam peak.

Moreover, corresponding roots of the first and second sets (SE, SE') of excitation means may be arranged on the same respective positions on the Schelkunoff unit circle, wherein at least two corresponding roots may be displaced angularly from one another while being situated on the common Schelkunoff unit circle, whereby the nulls of the respective radiation patterns do not overlap in the side-lobe region of interest for providing improved coverage.

Moreover, the radiation amplitude patterns (P, P') associated with the at least first and second set of excitation means are constructed to have an envelope with a null-fill difference in a given side-lobe region less than or equal to 25 dB below the main beam peak.

According to the second embodiment, at least one root of the first set (SE) of excitation means are displaced in a clockwise direction on the unit circle and wherein at least one root of the second set (SE') of excitation means are displaced in a counter clockwise direction.

According to the second embodiment the first set of excitation means (SE) are adapted for transmitting or receiving a first signal (S) and the second set of excitation means (SE') are adapted for transmitting or receiving a second signal (S') or a combination thereof.

Alternative realizations of the second embodiment are to move any number of roots between 1 and N−1 along the Schelkunoff unit circle. It should be understood that the second embodiment is also applicable for antenna arrangements having any number of antenna arrays, for instance three such as shown in FIG. 1 or in transmit—receive communication systems having unequal number of antenna arrays at both ends.

It should be understood that the number of radiating elements can be more or less compared to the example described above with 16 radiating elements.

It should moreover be understood that the second embodiment can not only be implement in elevation but also in azimuth.

It should further be understood that the second embodiment can be used for transmission or reception of signals as well as a combination thereof.

It should furthermore be understood that the second embodiment is also applicable to applications in which one or more antenna arrays is electrically beam-tilted, cf. FIG. 8*b*, or with one or more roots moved differently, clockwise or counter clockwise, along the Schelkunoff unit circle.

One advantage with the above antenna arrangement is that field strength reductions within a service area are largely mitigated. This is done by appropriately designing the amplitude of the antenna array radiation characteristics versus the angle seen from the antenna so as to "filling the first nulls", that is, increasing the magnitude of local field strength at the minima in the radiation amplitude patterns. According to the invention, an array antenna arrangement is excited in various ways in order to meet the above objective.

Another advantage of the second embodiment is that the two beams of a dual-polarized antenna arrangement are generated in such a way that the null directions in the elevation side-lobe region below the main beam peak are non-coinciding in order to improve the link budget within that angular region of interest. Still another advantage of the second embodiment compared to shaping the radiation patterns by positioning the roots associated with the radiation pattern off the Schelkunoff unit circle is that the peak gain drop is smaller.

Yet another advantage is that the correlation between signals received by two radiation patterns is reduced within the side-lobe lobe angular region of interest to improve transmit diversity, receive diversity and MIMO applications.

Combinations of the first and second root displacements as explained with regard to the first and the second embodiments are also envisaged in such a manner that roots are both radially and angularly displaced.

It should be moreover understood that the first and second embodiments are not only applicable to base-station antenna arrangements but also to antenna arrangements for fixed and mobile access points, user equipments, and other types of terminals.

What is claimed is:

1. An antenna arrangement, comprising:

at least two antenna arrays, each array comprising a plurality of radiating elements being arranged so as to have at least a plurality of corresponding radiating element positions, wherein for each radiating element there is associated an excitation means having a magnitude weight and a delay weight;

a first set of the excitation means being associated with a first array providing a first radiation pattern and a second set of the excitation means being associated with a second array providing a second radiation pattern, wherein one of the first and second sets of the excitation means has differing delay weights, and wherein at least two respective excitation means associated with a corresponding radiating element position of at least two respective arrays have at least two different magnitude weights; and, at least two respective excitation means associated with a corresponding radiating element position of at least two respective arrays have at least two different delay weights and wherein the excitation weights of the at least first and second sets of excitation means are selected so that the main beam directions of the at least two antenna arrays essentially coincide and so that at least the magnitude of a correlation coefficient associated with respective signals communicated over the at least first and second arrays is below 0.7 in a given side-lobe region with regard to the main beam peak, or so that the radiation amplitude patterns associated with the at least first and second set of excitation means have an envelope with a substantial null-fill difference in a given side-lobe region with regard to the main beam peak.

2. The antenna arrangement according to claim 1, wherein the corresponding roots of the first set of excitation means associated with the first array and the second set of excitation means associated with the second array are chosen such that the amplitude patterns of the first and second radiation patterns are essentially equal.

3. The antenna arrangement according to claim 2, wherein the remaining roots of the first and second excitation sets are arranged on the Schelkunoff unit circle.

4. The antenna arrangement according to claim 3, wherein the remaining roots of the first and second excitation sets are arranged on the same respective positions on the Schelkunoff unit circle.

5. The antenna arrangement according to claim 2, wherein the first set of excitation means is adapted for transmitting or receiving a first signal and the second set of excitation means is adapted for transmitting or receiving a second signal or a combination thereof.

6. The antenna arrangement according to claim 5, wherein the at least two signals are associated with data in a Multiple Input Multiple Output communication system.

7. The antenna arrangement according to claim 5, wherein the at least two signals are associated with data in a transmit or receive diversity communication system.

8. The antenna arrangement according to claim 1 wherein the roots associated with the first and second sets of excitation means are equal in numbers, whereby any given root for the first excitation set is associated with a corresponding root of the second excitation set wherein at least two corresponding roots of the first and second excitation sets are displaced with regard to one another.

9. The antenna arrangement according to claim 8, wherein the at least two corresponding roots of the first set and second set are positioned off the Schelkunoff unit circle, such that the phase patterns are different across the side-lobe region of interest for providing a low correlation between respective signals.

10. The antenna arrangement according to claim 9, wherein at least two additional corresponding roots of the first set and second set are positioned off the Schelkunoff unit circle.

11. The antenna arrangement according to claim 10, wherein the roots positioned off the Schelkunoff unit circle of the first set are positioned inside the Schelkunoff unit circle and the roots positioned off the Schelkunoff unit circle of the second set are positioned outside the Schelkunoff unit circle.

12. The antenna arrangement according to claim 9, wherein at least two corresponding roots are geometrically imaged in relation to one another with respect to a point on the common Schelkunoff unit circle.

13. The antenna arrangement according to claim 12, wherein the imaging corresponds to the two corresponding roots being geometrically inverted with regard to the Schelkunoff unit circle.

14. The antenna arrangement according to claim 1, wherein corresponding roots of the first and second sets of excitation means are arranged on the same respective positions on the Schelkunoff unit circle, and wherein at least two corresponding roots are displaced angularly from one another while being situated on the common Schelkunoff unit circle, whereby the nulls of the respective radiation patterns do not overlap in the side-lobe region of interest for providing improved coverage.

15. The antenna arrangement according to claim 1, wherein the radiation amplitude patterns associated with the at least first and second set of excitation means have an envelope null-fill difference in a given side-lobe region less than or equal to 25 dB below the main beam peak.

16. The antenna arrangement according to claim 15, wherein at least one corresponding root of the first set of excitation means is displaced in a clockwise direction on the unit circle and wherein at least one corresponding root of the second set of excitation means is displaced in a counter clockwise direction.

17. The antenna arrangement according to claim 1, wherein more than two arrays and more than two data streams are provided.

* * * * *